US007032665B1

(12) United States Patent
Berrier

(10) Patent No.: US 7,032,665 B1
(45) Date of Patent: Apr. 25, 2006

(54) SYSTEM AND METHOD FOR GRAVEL PACKAGING A WELL

(76) Inventor: Mark L. Berrier, 1102 Snowy Owl Ct., Austin, TX (US) 78746

( * ) Notice: Subject to any disclaimer, the term of this patent is extended or adjusted under 35 U.S.C. 154(b) by 224 days.

(21) Appl. No.: 10/301,463

(22) Filed: Nov. 21, 2002

Related U.S. Application Data

(60) Provisional application No. 60/332,222, filed on Nov. 21, 2001.

(51) Int. Cl.
*E21B 43/04* (2006.01)
*E21B 43/08* (2006.01)

(52) U.S. Cl. ..... 166/278; 166/51; 166/236

(58) Field of Classification Search ..... 166/278, 166/276, 81, 242.3, 236, 231, 51
See application file for complete search history.

(56) References Cited

U.S. PATENT DOCUMENTS 5,113,935 A * 5/1992 Jones et al. ..... 166/51
5,476,143 A * 12/1995 Sparlin et al. ..... 166/233
5,515,915 A * 5/1996 Jones et al. ..... 166/51
5,842,516 A * 12/1998 Jones ..... 166/56
6,227,303 B1 * 5/2001 Jones ..... 166/378
6,298,916 B1 * 10/2001 Tibbles et al. ..... 166/278
6,513,588 B1 * 2/2003 Metcalfe ..... 166/89.2
6,588,506 B1 * 7/2003 Jones ..... 166/278
6,644,406 B1 * 11/2003 Jones ..... 166/308.1
6,749,023 B1 * 6/2004 Nguyen et al. ..... 166/278
6,793,017 B1 * 9/2004 Nguyen et al. ..... 166/278
2002/0174984 A1 * 11/2002 Jones ..... 166/278
2002/0189808 A1 * 12/2002 Nguyen et al. ..... 166/278
2002/0189809 A1 * 12/2002 Nguyen et al. ..... 166/278
2003/0000700 A1 * 1/2003 Hailey ..... 166/278
2003/0029614 A1 * 2/2003 Michel ..... 166/278
2003/0159825 A1 * 8/2003 Hurst et al. ..... 166/278
2003/0221829 A1 * 12/2003 Patel et al. ..... 166/278
2004/0099412 A1 * 5/2004 Broome et al. ..... 166/51

* cited by examiner

*Primary Examiner*—Jennifer H. Gay
(74) *Attorney, Agent, or Firm*—Law Offices of Mark L. Berrier

(57) ABSTRACT

Systems and methods for gravel packing which provide a mechanism for a gravel slurry to bypass bridges which may form in the well intervals being packed. In one embodiment, a plurality of short, independent bypass flow paths are provided along the length of a well screen. Each of the bypass flow paths comprises a sub-interval of the length of the well screen. The bypass flow paths are preferably staggered to allow the upper ends of the flow paths to be spaced at intervals along the length of the well screen which are shorter than the lengths of the flow paths themselves.

2 Claims, 13 Drawing Sheets

SYSTEM AND METHOD FOR GRAVEL PACKAGING A WELL

CROSS REFERENCE TO RELATED APPLICATIONS

This application claims priority to U.S. Provisional Patent Application Ser. No. 60/332,222, filed Nov. 21, 2001 by Mark L. Berrier for a "System and method for gravel packing a well," which is incorporated by reference as if set forth herein in its entirety.

BACKGROUND OF INVENTION

1. Field of the Invention

This invention relates to systems and methods for gravel packing a well.

2. Related Art

In the production of hydrocarbons (e.g., oil) from hydrocarbon-bearing formations, a well is drilled from the surface of the earth into the formation. The well may be completed by employing conventional completion practices. For example, casing may be run in the well and cemented, and perforations may be formed through the casing and the cement that surrounds it. This results in an open production interval through which hydrocarbons can flow into the well.

If the production interval is in an unconsolidated or poorly consolidated formation, sand may be produced along with the hydrocarbons. This is undesirable for many reasons. The sand is abrasive and increases wear on components within the well, such as tubing, pumps and valves. The sand must also be removed from the hydrocarbons at the surface. The sand may also partially or completely clog the well, thereby making it necessary to work over the well (which is very expensive). Still further, sand which flows out of the formation may leave a cavity in the formation which may make it unstable and vulnerable to collapse of the formation and the casing.

One means for resolving these problems is to pack the production interval (or at least a part of it) with gravel. (The size and material of the gravel particles may vary, depending upon the particular situation.) The gravel pack serves several purposes. For example, it serves to filter sand from the hydrocarbons that flow into the well. The gravel pack also serves to prevent sand from flowing out of the formation and leaving it unstable. The gravel pack also provides support for the casing and formation in the packed interval so tha they are less likely to collapse.

Conventional gravel packing techniques generally involve the insertion of a well screen into the well. An annulus is thereby formed between the screen and the wall of the well. A slurry of gravel (gravel suspended in a fluid) is injected into the annulus until the volume between the screen and well bore (the wall of the well) is filled.

Conventional gravel packing techniques, however, are not without problems themselves. For instance, it is not uncommon for a gravel pack to have voids (in which the gravel has not completely filled the space). It is particularly difficult to ensure that there are no voids when the interval to be packed is inclined or horizontal. The voids may allow sand to flow into the well and reduce the overall effectiveness of the gravel pack.

One of the primary causes of voids in a gravel pack is the formation of gravel bridges. Gravel bridges form when particles of gravel become lodged between the well screen and wellbore prior to reaching the end of the volume being packed. After a bridge has begun to form, additional particles accumulate as they become lodged between the bridge itself and the screen or wellbore. The lateral extent of the bridge may increase until it eventually blocks further flow of the gravel slurry so that voids form behind the bridges.

One means for resolving the problem of gravel bridge formation is the use of a perforated shroud around the well screen. The shroud effectively separates the annular region between the screen and well bore into an inner annulus between the screen and the shroud, and an outer annulus between the shroud and the wellbore. The shroud does not prevent the formation or growth of gravel bridges, but if gravel bridges form in the outer annulus, the gravel slurry can flow into the inner annulus through the perforations in the shroud. The slurry can then bypass the bridges and flow back into the outer annulus through the perforations. Voids behind bridges can therefore be filled so that a complete gravel pack is formed.

BRIEF DESCRIPTION OF DRAWINGS

Other objects and advantages of the invention may become apparent upon reading the following detailed description and upon reference to the accompanying drawings.

Figure 1:
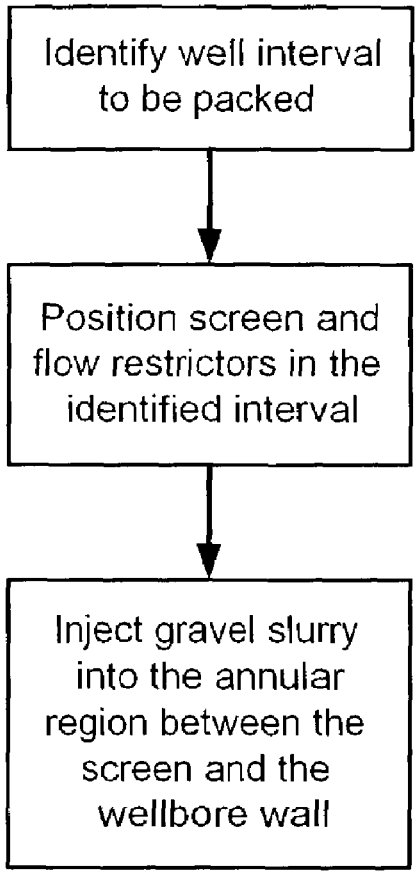
FIG. 1 is a flow diagram illustrating a method in accordance with one embodiment of the invention.

While the invention is subject to various modifications and alternative forms, specific embodiments thereof are shown by way of example in the drawings and the accompanying detailed description. It should be understood, however, that the drawings and detailed description are not intended to limit the invention to the particular embodiment which is described. This disclosure is instead intended to cover all modifications, equivalents and alternatives falling within the scope of the present invention as defined by the appended claims.

DETAILED DESCRIPTION

A preferred embodiment of the invention is described below. It should be noted that this and any other embodiments described below are exemplary and are intended to be illustrative of the invention rather than limiting.

One embodiment of the present invention does not separate the annulus between the screen and wellbore into inner and outer annuli, but instead limits the lateral growth of bridges so that they cannot block a substantial portion of the annulus. The gravel slurry can therefore bypass the bridges laterally (instead of by flowing between inner and outer annuli).

Broadly speaking, the invention comprises methods and systems for gravel packing a well. In one embodiment, gravel bridges which form in the borehole are prevented from freely expanding laterally and blocking the flow of a gravel slurry into the area to be packed. A preferred embodiment of the inventive method comprises inserting a screen into the well to form a generally annular area between the screen and the well bore. A plurality of lateral flow restrictors, or restrictor plates, are positioned in the annular area to partially block lateral, or tangential, flow within the annular region. In at least some embodiments, longitudinal flow of fluids (in the axial direction of the borehole) is substantially unimpeded.

It should be noted that "lateral" will be used herein to describe the flow of fluids around the circumference of the screen roughly orthogonal to the axis of the borehole. It should also be noted that other embodiments may use types of lateral flow restrictors other than simple plates, so reference to the flow restrictor plates of this embodiment should not be construed as limiting.

Ideally, a gravel packing method will achieve a complete pack between the gravel screen and the well bore. In other words, there are no voids in the pack and the annular area between the screen and the well bore is completely filled with gravel. The present method employs plates positioned to extend longitudinally and radially outward from the screen. These plates partially restrict the movement of gravel in the lateral direction. Thus, if a gravel bridge begins to form, it is confined to the portion of the annular region between the two of the restrictor plates. Although the bridge will prevent the longitudinal flow of gravel in the blocked portion of the annular region, it will not restrict the flow of the gravel slurry in laterally adjacent portions. The slurry can therefore bypass the bridge and fill any voids which would otherwise be formed. (It should be noted that, because of lateral flow is only partially blocked by the plates, the slurry can flow behind the bridge to fill in voids in that area).

Referring to FIG. 1, a flow diagram illustrating one embodiment of the inventive method is shown. It can be seen from this figure that, after the interval of the well which is of interest is identified, a gravel screen and restrictor plates are positioned in the identified interval. A gravel slurry is then pumped into the annular region between the screen and the well bore to fill this region.

This method can be performed using a variety of different types of restrictor plates. For example, referring to FIG. 2, an exemplary restrictor plate is shown. In this embodiment, restrictor plate 24 forms a series of fins 21 extending from near the outer surface of screen 22 toward well bore 23. A plurality of these plates (fins) are positioned around the circumference of the screen. This is illustrated in FIGS. 3A and 3B.

Figure 2:
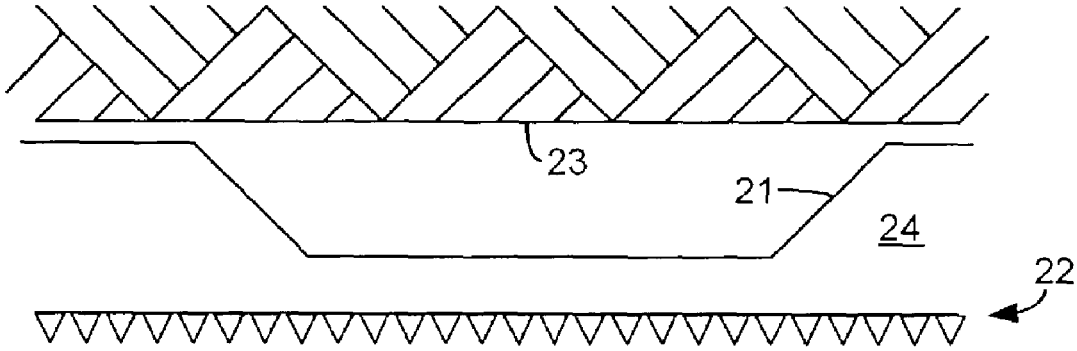
FIG. 2 is a diagram illustrating a flow restrictor plate in accordance with one embodiment of the invention.
Figure 3B:
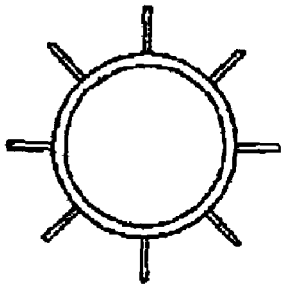
FIGS. 3A and 3B are diagrams illustrating a plurality of restrictor plates positioned around the periphery of a well screen in accordance with one embodiment of the invention.
Figure 3A:
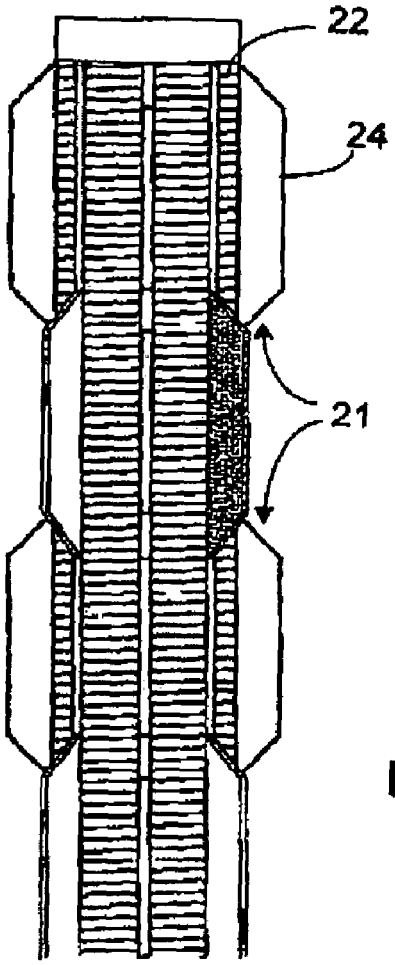

Referring to FIGS. 3A and 3B, two diagrams illustrating a section of a well screen is shown with restrictor plates of the type depicted in FIG. 2. FIG. 3A is a side view and FIG. 3B is a cross-sectional view. This system of FIGS. 3A and 3B has restrictor plates 24 positioned around the screen 22 at eight regular intervals of 45 degrees. Adjacent plates have fins 21 which are staggered longitudinally so that a fin of one plate is at the same longitudinal position as a gap in the adjacent plate. This arrangement may allow the slurry to more easily flow around (and behind) gravel bridges.

Figure 4:
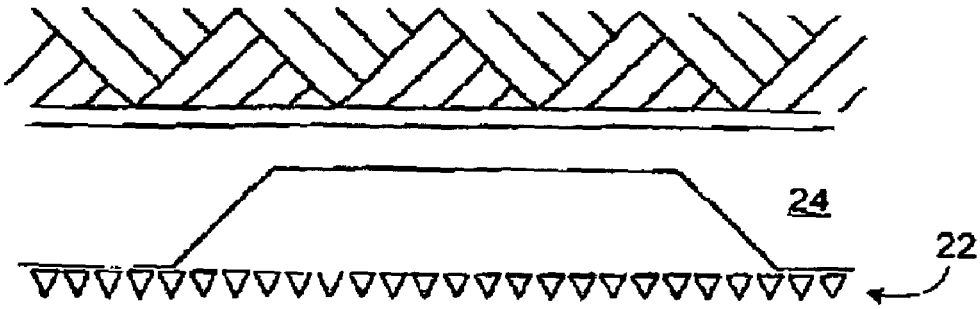
FIG. 4 is a diagram illustrating a restrictor plate system in accordance with an alternative embodiment of the invention.

Referring to FIG. 4, an alternative embodiment of the restrictor plate system is shown. In this embodiment, the restrictor plates 24 have a shape that might be described as the inverse of the restrictor plates of FIGS. 2–4. In other words, rather than forming fins which extend outward from the screen 22, the fins extend radially inward toward the screen. The restrictor plates may or may not touch the screen at intermediate points along their lengths. The restrictor plates may be connected to the screens only at their ends. If additional support is needed for the restrictor plates along their lengths, they may be shaped so that they contact the screen at additional points (in addition to their ends).

The restrictor plate configurations shown in FIGS. 2–4 have portions (the "fins") which extend substantially from the screen to the well bore. Another alternative embodiment extends only a portion of the way from the screen to the well bore (or vice versa). One such embodiment is illustrated in FIG. 5.

Figure 5:
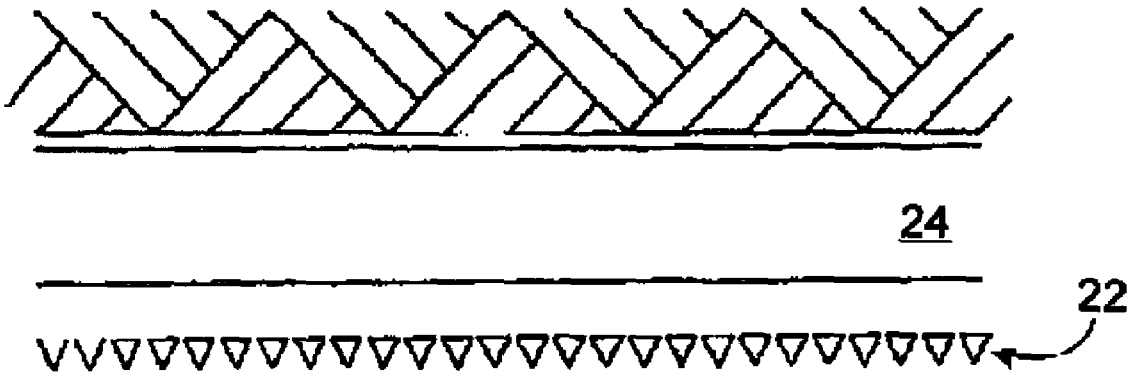
FIG. 5 is a diagram illustrating a restrictor plate that extends only partially between the screen and a well bore in accordance with one embodiment of the invention.

Referring to FIG. 5, a restrictor plate that extends only partially between the screen and a well bore is shown. In this embodiment, the restrictor plate 24 extends half way from the well bore to the screen 22. The restrictor plate is sized so that it is in contact with (or almost in contact with) the well bore. Consequently, the annular region between the screen and the well bore can be thought of as comprising an inner portion which is substantially undivided, and an outer portion which is segmented by the restrictor plates.

In another alternative embodiment, the restrictor plates may be substantially the same width along their lengths (as in the embodiment of FIG. 5), but they may be positioned to be in contact (or nearly so) with the screen. In this embodiment, the annular region comprises a substantially undivided outer portion and a segmented inner portion.

Figure 6:
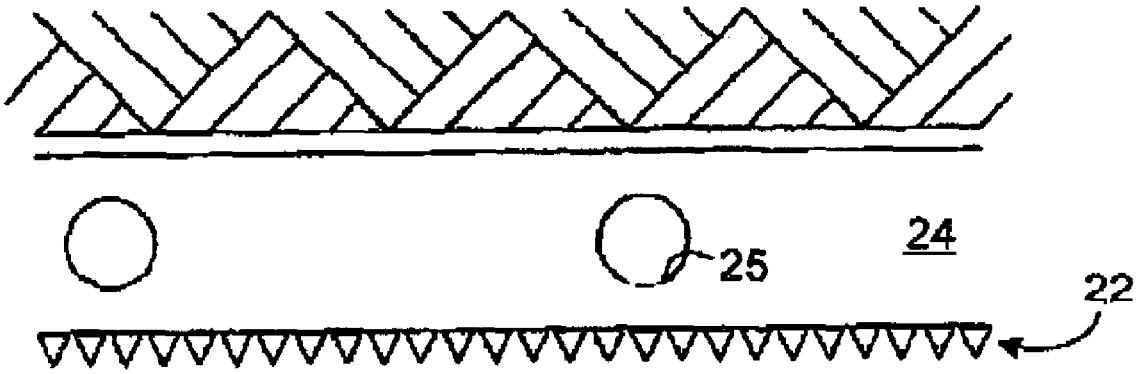
FIG. 6 is a diagram illustrating a restrictor plate that extends substantially between the screen and a well bore in accordance with one embodiment of the invention.

Still another embodiment is illustrated in FIG. 6. The embodiment shown in this figure utilizes restrictor plates 24 which are sized to extend substantially from the screen 22 to the well bore and which have apertures 25 therethrough at intervals along their lengths. While the restrictor plate apertures depicted in FIG. 6 are circular and regularly spaced, their shapes and spacings, as well as their sizes, may vary.

It is contemplated that the restrictor plate systems described herein will enable substantially complete gravel packing of well intervals by restricting the lateral extent of gravel bridges which form between the screen and the well bore, and by allowing the gravel slurry injected into the well to bypass such bridges and fill in any voids which would otherwise form behind these bridges.

Figure 7A:
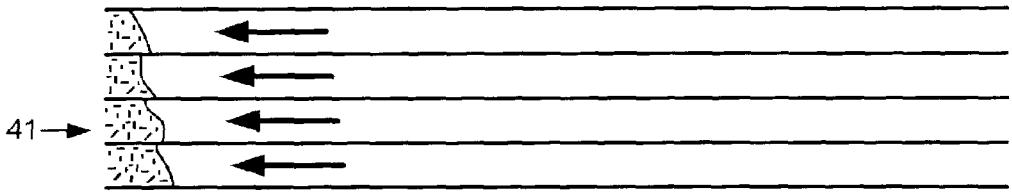
FIGS. 7A–7D are diagrams illustrating the manner in which a gravel pack is formed using the present system and methods.
Figure 7B:
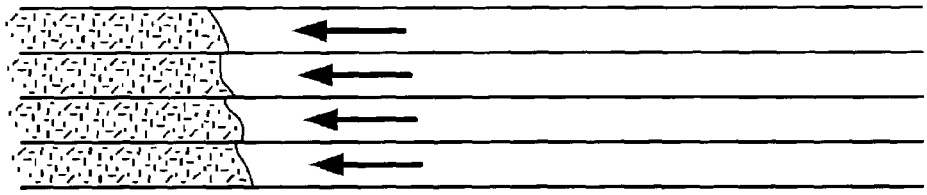
Figure 7C:
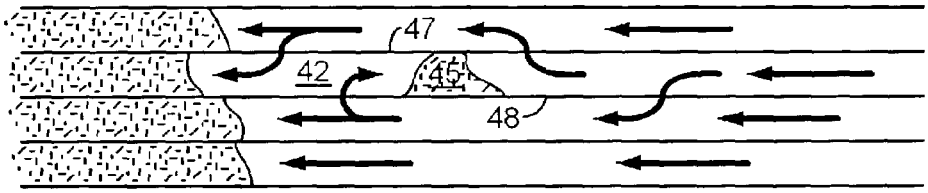
Figure 7D:
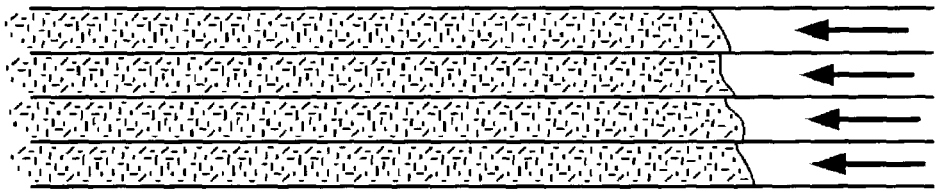

This is shown in FIGS. 7A 7D. These figures illustrate the manner in which a gravel pack is formed using the present system and methods. In FIG. 7A, a gravel slurry (the flow of which is represented by the arrows) flows into the annular region between the screen and the well bore. Although the flow of the slurry is primarily longitudinal, it should be noted that it may also flow laterally through the gaps in the restrictor plates. As the slurry reaches the end of the annular region, the gravel is deposited and forms a pack 41. In the initial stages of its formation, pack 41 is substantially complete (i.e., it has no appreciable voids), as shown in FIG. 7B.

Referring to FIG. 7C, a gravel bridge 45 may begin to form. As a result, the slurry may be prevented from flowing through the area occupied by the bridge and a void may potentially form in the area 42 behind it. Restrictor plates 47 and 48, which are adjacent to the forming bridge (45), block the lateral growth of the bridge. Thus, the slurry can flow by bridge 45 through channels on the opposite sides of restrictor plates 47 and 48 (indicated by the arrows). Gaps in restrictor plates 47 and 48 than the allow the slurry to flow into void 42, resulting in a substantially complete gravel pack.

The basic principle of operation of the various embodiments described above is illustrated in FIGS. 7A–7D. A gravel bridge begins to form when a collection of individual particles of gravel become lodged between the well screen and the well bore. Once these initial particles of gravel have become lodged, additional particles can more easily become lodged against the initial group of particles. As the additional particles collect, the bridge grows and blocks an increasingly large portion of the annulus between the well screen and the well bore. As the bridge grows, the likelihood increases that voids will be left behind the bridge, resulting in an incomplete gravel pack. The use of restrictor plates as described herein limits the lateral growth of bridges that begin to form in the annular region between the well screen and the well bore. Thus, in order for the bridge to block a portion of the annular region which extends beyond that portion which lies between two plates, bridges must independently form in different portions of the annular region. The likelihood that this will occur at the same longitudinal position is quite low. The gravel slurry is therefore very likely to be able to flow past a gravel bridge on the opposite side of one of the restrictor plates, and then fill in behind the bridge when the slurry reaches a crossover point where some lateral flow is permitted.

Keeping this basic principle in mind, numerous variations of the embodiments described above will be apparent to those of ordinary skill in the art of the invention. For example, although the embodiments described above use simple restrictor plates that extend longitudinally along the screen, other embodiments of the restrictor plates may be angled, so that a lateral component of flow is actually forced. An example of such an embodiment is shown in FIG. 8.

Figure 8:
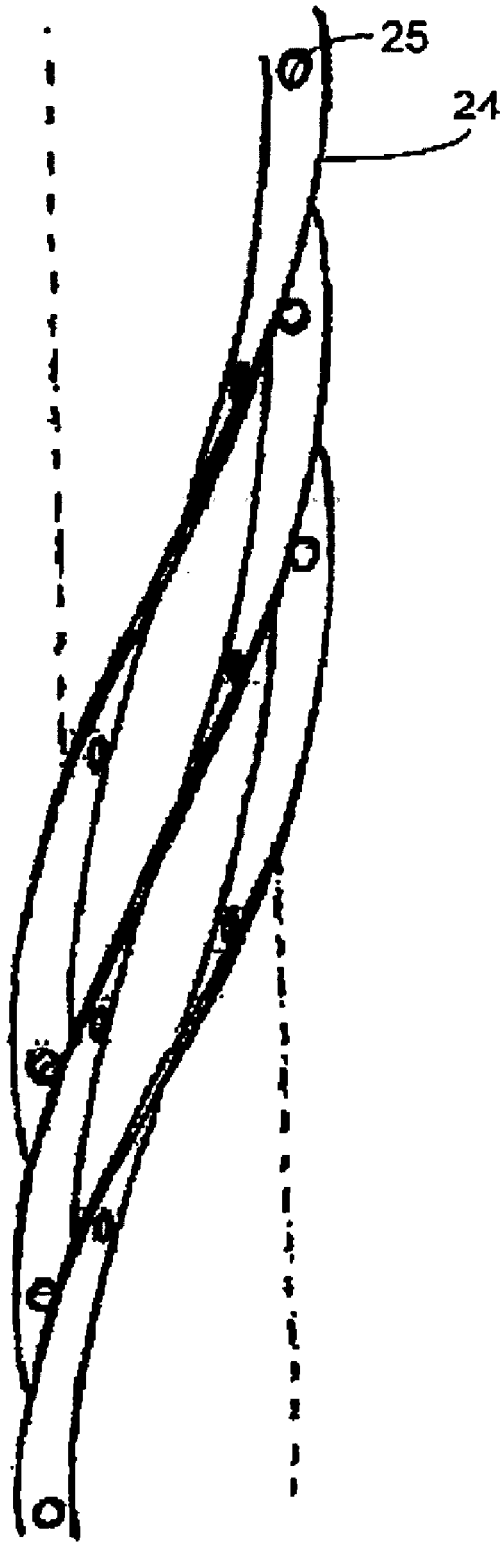
FIG. 8, is a diagram illustrating a system which utilizes helical restrictor plates in accordance with one embodiment of the invention.

Referring to FIG. 8, one embodiment of the present invention utilizes helical restrictor plates as shown. Only three of the helical restrictor plates 24 are shown. The restrictor plates are similar to those shown in FIG. 6. That is, the restrictor plates extend substantially all of the way between the well screen and the well bore, but have apertures 25 therethrough at intervals along their lengths which allow the gravel slurry to flow through to the other side of the plate. The restrictor plates of FIG. 8, however, wind around the well screen (indicated by the dotted line) in a helical fashion. While it is contemplated that a helix having a relatively shallow pitch will be preferred, a higher pitch may also be effective. Both may be considered, for the purposes of this disclosure, to substantially block lateral flow of gravel slurries. (Apertures or other breaks in the restrictor plates are not considered to negate the fact that the lateral flow is substantially blocked.)

The embodiments of the present invention may include the following exemplary embodiments, as well as others.

A system comprising: a well screen; and a plurality of flow restrictors positioned around the exterior of the well screen, wherein the flow restrictors are oriented to partially block lateral (tangential) flow around the well screen while allowing substantially unrestricted longitudinal flow along the exterior of the well screen. A system comprising: a well screen; and a plurality of flow restrictors positioned around the exterior of the well screen, wherein the flow restrictors are oriented to partially block lateral (tangential) flow around the well screen while allowing substantially unrestricteed longitudinal flow along the exterior of the well screen; wherein the flow restrictors comprise flat, elongated plates which are oriented to be substantially coplanar with the axis of the well screen; and wherein each of the plates have a shape selected from the group consisting of: fins; inverted fins; and rectangles with apertures therethrough. A system comprising: a well screen; and a plurality of flow restrictors positioned around the exterior of the well screen, wherein the flow restrictors are oriented to partially block lateral (tangential) flow around the well screen while allowing substantially unrestricted longitudinal flow along the exterior of the well screen; wherein the flow restrictors comprise helical plates, wherein the plates have apertures therethrough at intervals along their lengths. A method comprising: positioning a well screen in a well bore; positioning a plurality of flow restrictors in an annulus between the well screen and the well bore, wherein the flow restrictors are oriented to partially block lateral (tangential) flow around the well screen while allowing substantially unrestricted longitudinal flow along the exterior of the well screen; and injecting a gravel slurry into the annulus. A method comprising: positioning a well screen in a well bore; injecting a gravel slurry into the annulus; restricting lateral growth of gravel bridges which form between the well screen and the well bore; and providing flow paths laterally adjacent to the gravel bridges, wherein the flow paths allow the gravel slurry to bypass the bridges and fill voids behind the gravel bridges. The present invention comprises systems and methods for gravel packing which avoid the problems experienced by conventional systems. Generally speaking, the present systems and methods provide means for a gravel slurry to bypass bridges which may form in the well intervals being packed.

In one embodiment, the inventive method comprises inserting a screen into the well to form a generally annular area between the screen and the well bore. A plurality of lateral flow restrictors, or restrictor plates, are positioned in the annular area to partially block lateral, or tangential, flow within the annular region. In at least some embodiments, longitudinal flow of fluids (in the axial direction of the borehole) is substantially unimpeded.

In another embodiment, a plurality of short, independent bypass flow paths are provided along the length of a well screen. Each of the bypass flow paths comprises a sub-interval of the length of the well screen. The bypass flow paths are preferably staggered to allow the upper ends of the flow paths to be spaced at intervals along the length of the well screen which are shorter than the lengths of the flow paths themselves.

In another embodiment, a sleeve having a series of variable-flow openings therein is positioned around a well screen. The sleeve is configured to allow the sizes of the openings to be changed while the system is an operation. Preferably, the sizes of the openings are varied such that the openings in the far end of the sleeve (with respect to the well head) are initially larger than the openings in the near end of the sleeve. As a gravel slurry is pumped through the sleeve, it will tend to initially flow out the larger openings at the far end of the sleeve, and then flow through openings closer to the near end of the sleeve as these openings become larger and as the gravel from the slurry fills the far end of the well interval in which the system is located.

The embodiments of the invention depicted in FIGS. 1–8 are configured to prevent the lateral growth of gravel bridges that may begin to form on a single side of the well screen. These embodiments may not work as well in situations in which the fluid loss occurs around the circumference of the well screen. In this situation, gravel bridges may independently form on all sides of the well screen at approximately the same axial position. Since individual gravel bridges form on all sides of the well screen, lateral restriction of the growth as any one of the gravel bridges may be ineffective to prevent blockage of the flow of the gravel slurry and resulting voids behind the bridges.

Figure 9:
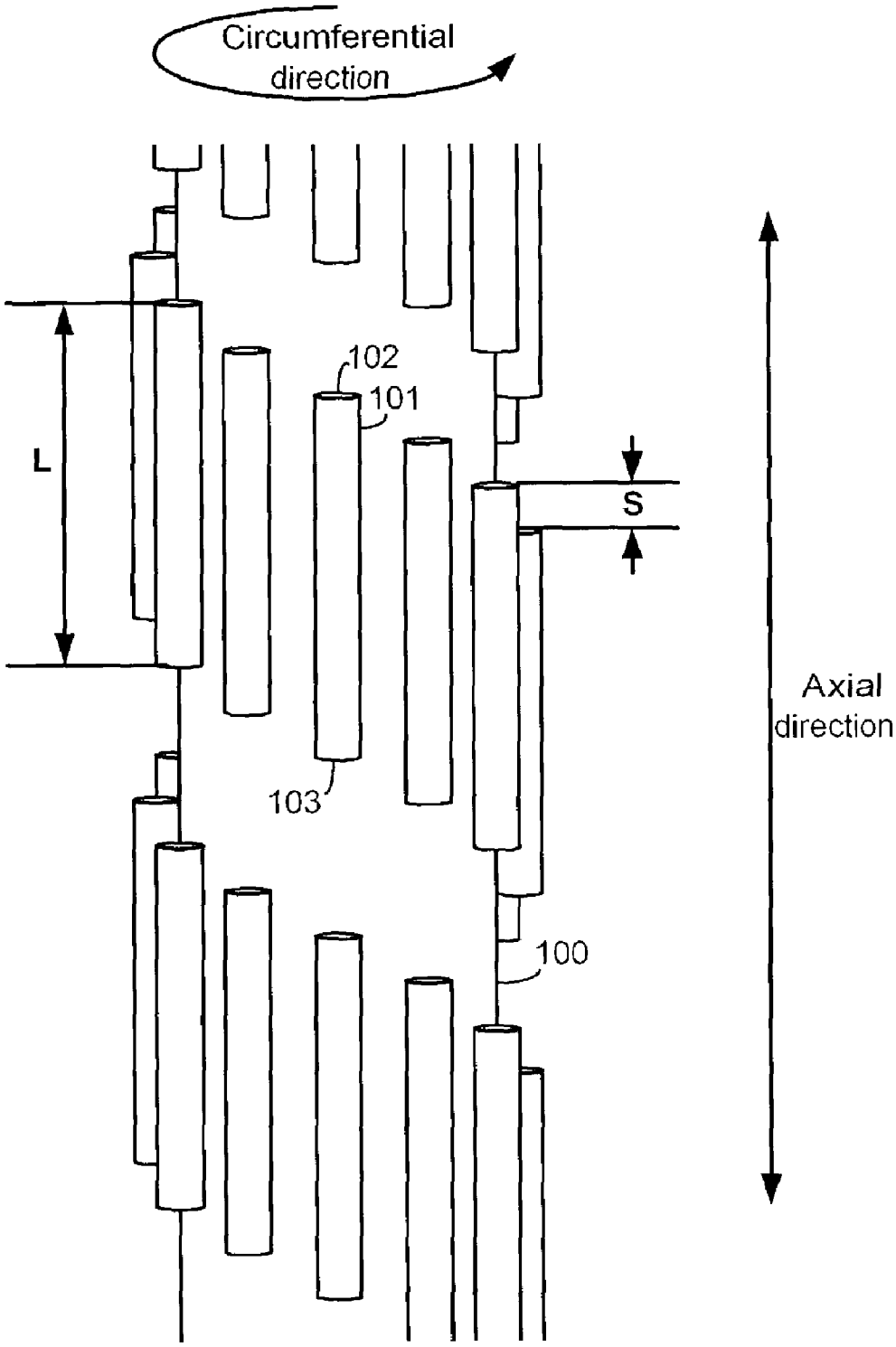
FIG. 9 is a diagram illustrating a plurality of short bypass flow paths created using conduits positioned around the exterior of a well screen in accordance with one embodiment is shown.

Referring to FIG. 9, another embodiment of the invention is shown. In this embodiment, a plurality of short bypass flow paths are created using conduits 101. Conduits 101 in this embodiment are positioned at various locations around the circumference of a well screen 100. Each conduit 101 has an upper end 102 and a lower end 103. A portion of the gravel slurry pumped into the annular region between well screen 100 and the well bore may enter conduit 101 at upper and 102, flow through the conduit and exit at lower end 103. In this manner, the gravel slurry may bypass any bridges that form between the upper and 102 and lower end 103.

In the embodiment depicted in FIG. 9, each of the conduits has a length, L, which is substantially shorter than the overall length of well screen 100. Conduits 101 are positioned around well screen 100 such that the upper ends of the conduits have a relative axial spacing, S, which is less than the length L of the individual conduits. (It should be noted that spacing S need not be determined between adjacent conduits—two conduits which are positioned with their upper ends at the closest axial positions (i.e., axially successive conduits) may themselves be on opposite sides of the well screen.) The spacing of the conduits is less than the length of the conduits in order to provide overlap in the axial positions of the conduits. This ensures that, no matter where a bridge forms along the axial length of the well screen, it will be bypassed by one or more of the conduits.

Figure 10:
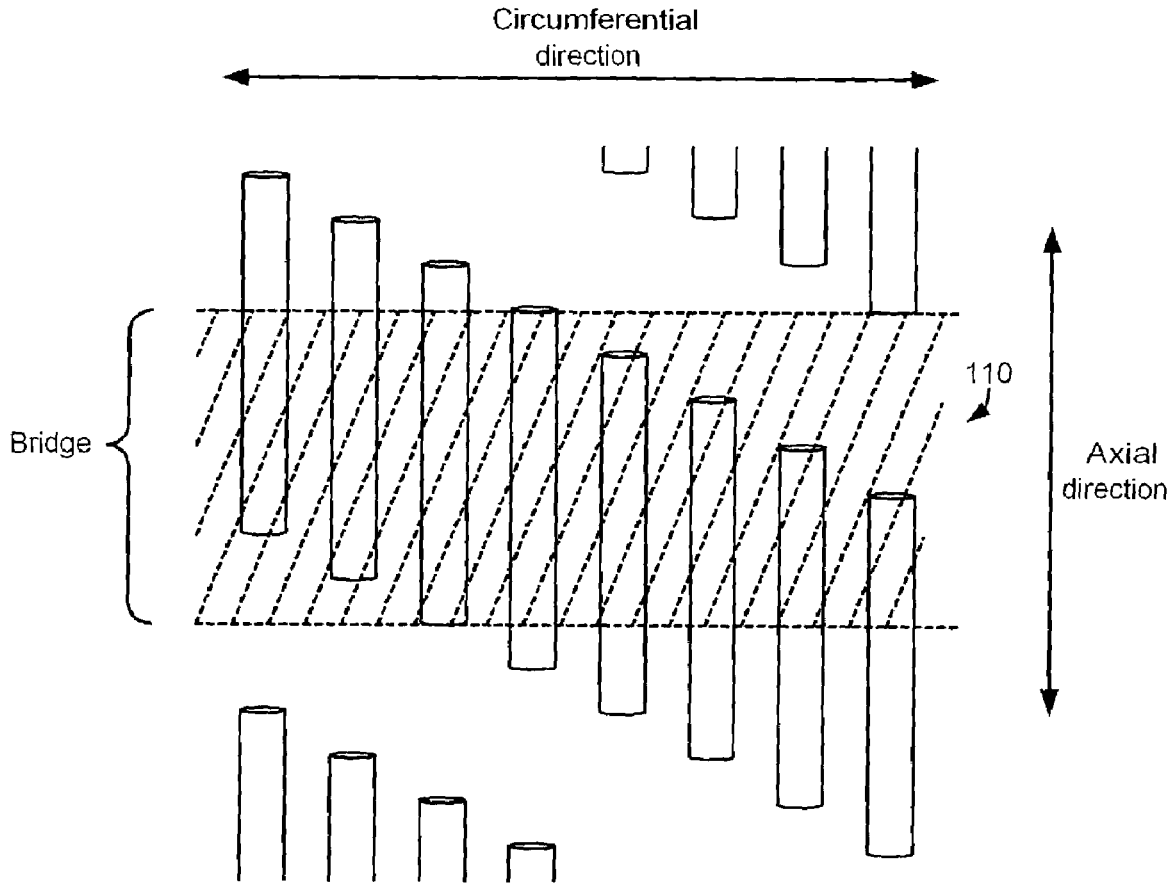
FIG. 10 is a diagram corresponding to FIG. 9 which illustrates the positions of the conduits around the circumference of the well screen as mapped to linear positions.

This is shown more clearly in FIG. 10 which illustrates the axial overlap of the conduits. In this figure, the position of the conduits around the circumference of the well screen are mapped to linear positions. In other words, the right side of the figure wraps around to the left side of the figure. It can be seen from the figure that a gravel bridge 110 forming anywhere along the length of the well screen will be bypassed by one or more of the conduits, as long as the bridge is less than (L-S) wide.

It should be noted that, although the conduits illustrated in FIGS. 9 and 10 all have the same lengths L and axial spacings S, this need not be the case in other embodiments. Each of the conduits may have a different length, and there may be a different axial spacing between any two conduits. In fact, it may be desirable to vary the specific lengths and spacings of the individual conduits in order to optimize the system for a particular application. Also, while the conduits of FIGS. 9 and 10 are substantially parallel to the axis of the well screen, the conduits of other embodiments may be skewed with respect to the axis of the well screen so that gravel slurry entering a conduit at a particular circumferential position may exit the conduit at a different circumferential position.

It should also be noted that the conduits may be of various types. For instance, in one embodiment, they may be simple tubular conduits that are attached to the well screen at appropriate locations. In another embodiment which combines the bypass conduits with the lateral flow restrictors described above, the conduits may be roughly fin-shaped (e.g., as shown in FIG. 3B). The fin-shaped conduits would, however, be hollow so that they could provide a means to bypass gravel bridges which might form around the fins. In yet another embodiment, the conduits may be formed using a corrugated metal sheet in which is wrapped around the well screen. This embodiment will be described in more detail below.

Figure 11:
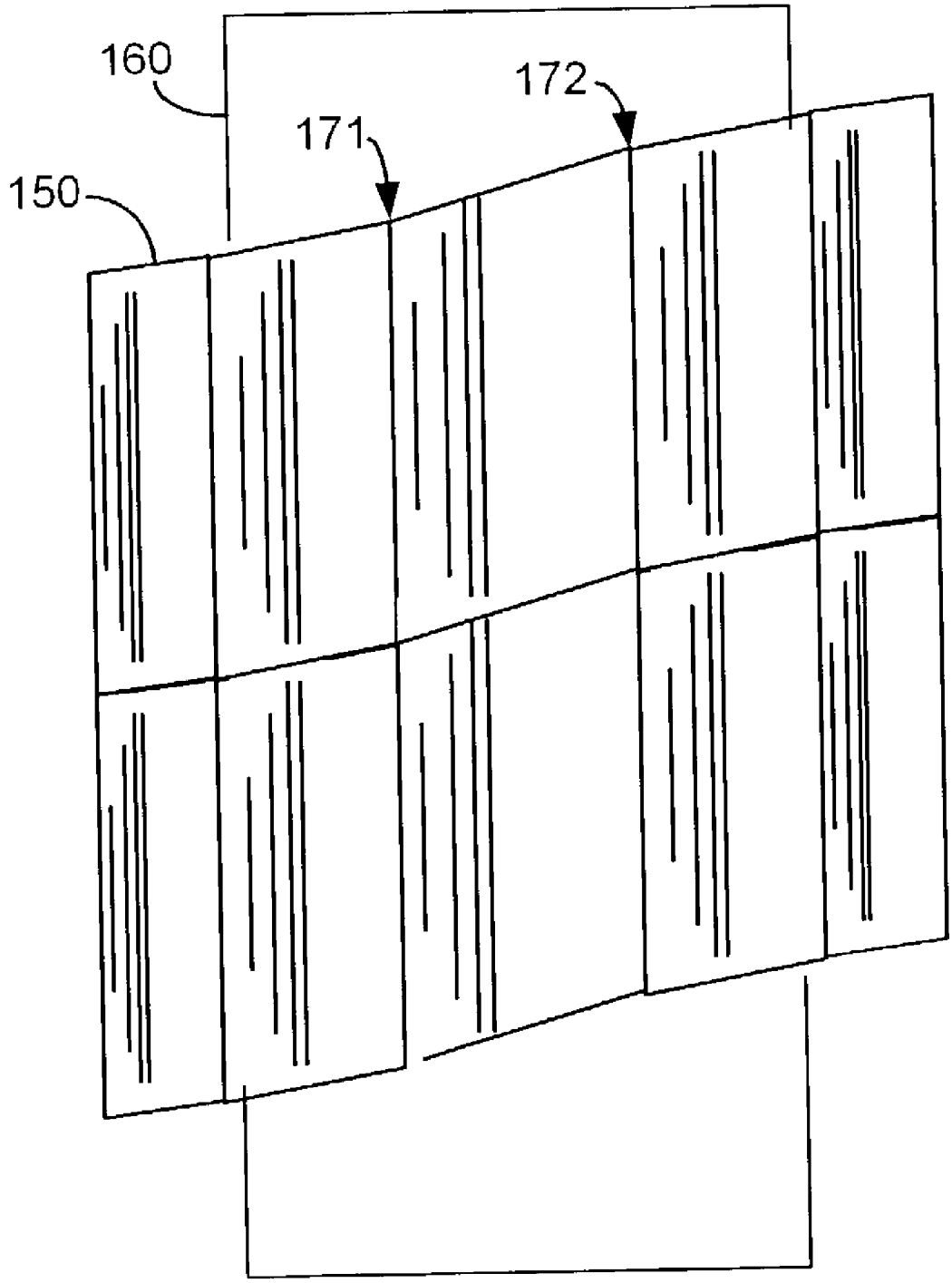
FIG. 11 is a diagram illustrating a side view of a corrugated metal sheet which is wrapped around a well screen to form a plurality of conduits in accordance with one embodiment.
Figure 12:
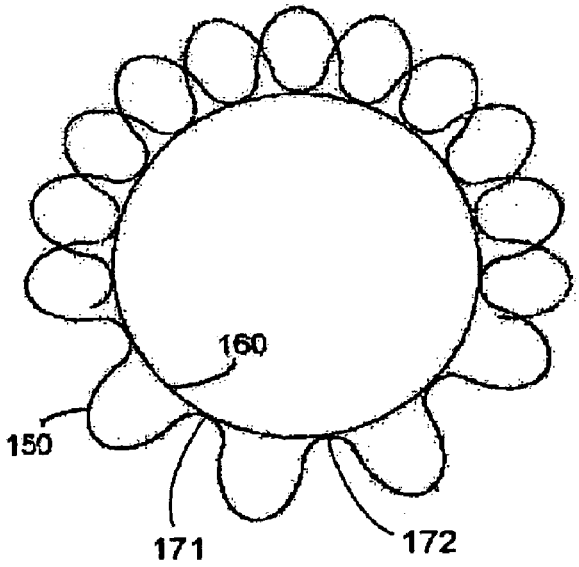
FIG. 12 is a diagram illustrating a top view of a corrugated metal sheet which is wrapped around a well screen to form a plurality of conduits in accordance with one embodiment.

Referring to FIGS. 11–12, a pair of diagrams illustrating an embodiment which uses a corrugated metal sheet to form a plurality of conduits around a well screen are shown. Referring to FIG. 11, corrugated metal sheet 150 is wrapped around well screen 160 in a helical fashion. Because metal sheet 150 is corrugated, it does not lie flat against the surface of well screen 160 when it is wrapped around the well screen, but instead contacts the well screen periodically around its circumference (e.g., along lines 171 and 172). Between each of the lines of contact, a conduit is formed. This creates a series of conduits that are regularly spaced, both around the circumference of the well screen (circumferential spacing) and along the length of the well screen (axial spacing).

In one embodiment, the circumferential spacing of the corrugations (hence the conduits) is not evenly divided into the circumference of the well screen. In other words, the lines along which the corrugated metal sheet makes contact with the well screen do not fall in the same circumferential locations each time the metal sheet wraps around the well screen. In the embodiment illustrated in FIG. 12, approximately 9.5 corrugations fit around the circumference of the well screen. The effect of this is to cause the conduits which are successively positioned along the length of the well screen not to be aligned. This allows a gravel slurry flowing through a particular conduit not only to exit the conduit and fill the well interval at intermediate points along the length of the well screen, but also to flow into more than one of the successive conduits along the length of the screen. Alternatively, the successive conduits could be aligned, but a gap may be left between them to allow the gravel slurry to exit/enter the different conduits.

Figure 13:
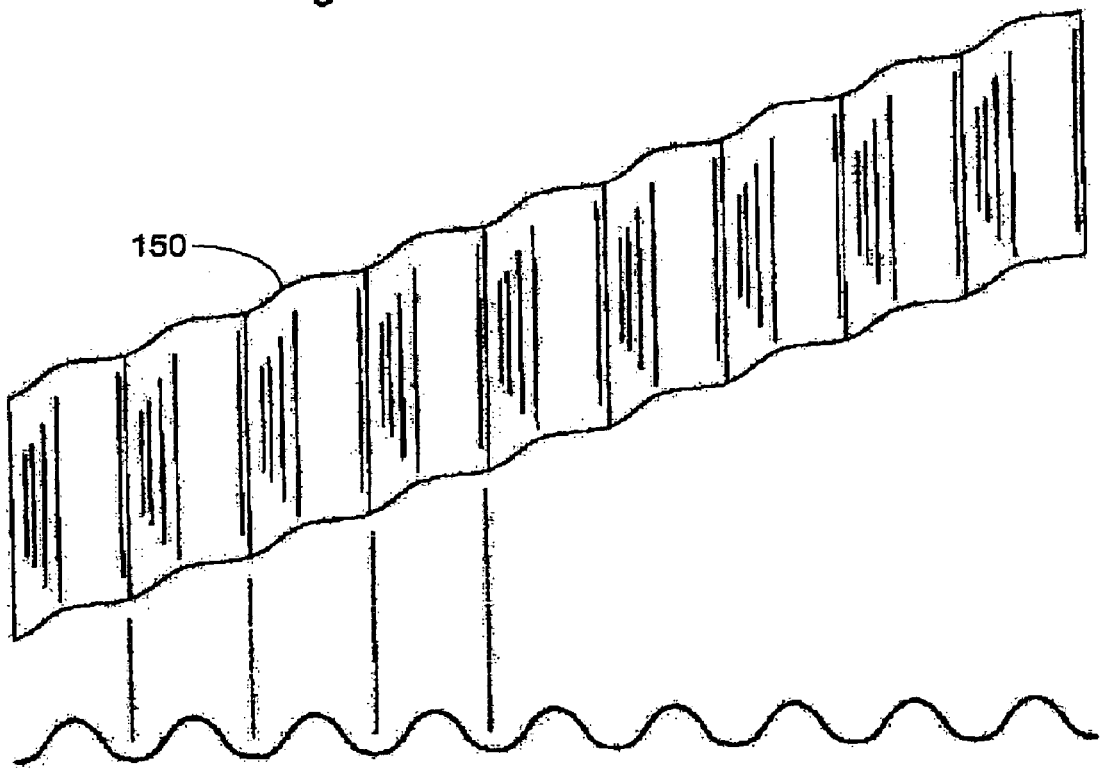
FIG. 13 is a diagram illustrating a corrugated metal sheet prior being wrapped around a well screen.
Figure 14:
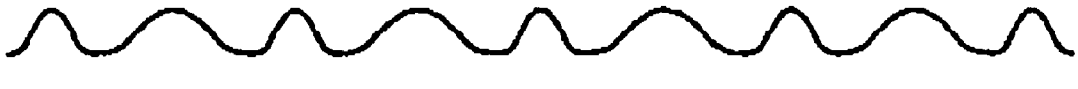
FIG. 14 is a diagram illustrating a metal sheet having irregular corrugations in accordance with one embodiment.
Figure 15A:
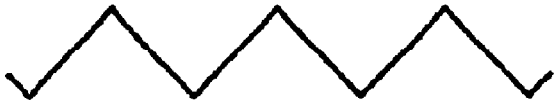
FIG. 15 is a diagram illustrating metal sheets having angular corrugations in accordance with one embodiment.
Figure 15B:
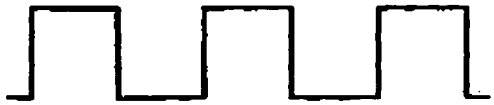

It is contemplated that the use of a corrugated metal sheet which is helically wrapped around the well screen will provide a simple and efficient method for manufacturing the well screen-conduit assembly. Referring to FIG. 13, corrugated metal sheet 150 is shown prior being wrapped around the well screen. It can be seen that the corrugations are sinusoidal in this embodiment. In other embodiments, the corrugations may be altered to achieve specific conduit configurations. For example, the corrugations could be irregular (see FIG. 14), or they could be angular (see FIG. 15). In FIG. 13, it can be seen that the corrugations are angled with respect to the length of the sheet. This angle depends upon the pitch of the helix formed by the sheet when it is wrapped around the well screen. It is contemplated that the corrugations should be parallel to the longitudinal axis (centerline) of the well screen. While it is not necessary that the conduits be aligned with the longitudinal axis, misaligned corrugations would make the sheet ore difficult to wrap around the well screen.

As indicated above, another alternative embodiment comprises a system in which a sleeve having a series of variable-flow openings therein is positioned around a well screen. The sizes of the openings are changed to allow the gravel slurry to flow through different flow paths, thereby avoiding formation of bridges or alternatively allowing voids behind bridges to be filled.

Figure 16:
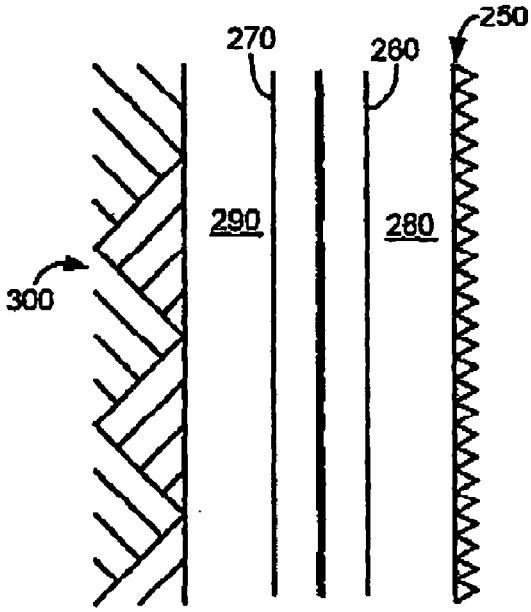
FIG. 16 is a cross-section of a portion of a well screen in accordance with an alternative embodiment.

Referring to FIG. 16, a cross-section of a portion of a well screen in accordance with an alternative embodiment is shown. In this embodiment, a well screen 250 is surrounded by a pair of tubular sleeves 260, 270. The tubular sleeves separate an internal flowpath 280 from an external flowpath 290. Each of the tubular sleeves has a set of apertures therethrough, wherein when the apertures overlap, an aperture is formed between internal flowpath 280 and external flowpath 290. Internal flowpath 280 comprises the annular region between sleeve 260 and well screen 250, while external flowpath 290 comprises the annular region between sleeve 270 and the well bore. The relative positions of the tubular sleeves is adjusted so that the apertures between the internal and external flowpaths vary in a manner which prevents and/or remedies the formation of gravel bridges between the tubular sleeves and the well bore 300.

As indicated above, an alternative embodiment comprises a well screen with a sleeve over it, wherein the sleeve has one or more variable-opening apertures therethrough for allowing a gravel slurry to pass from the interior of the sleeve to the exterior, thereby filling the completion region around the well screen.

Figures 17A, 17B, 17C, 17D:
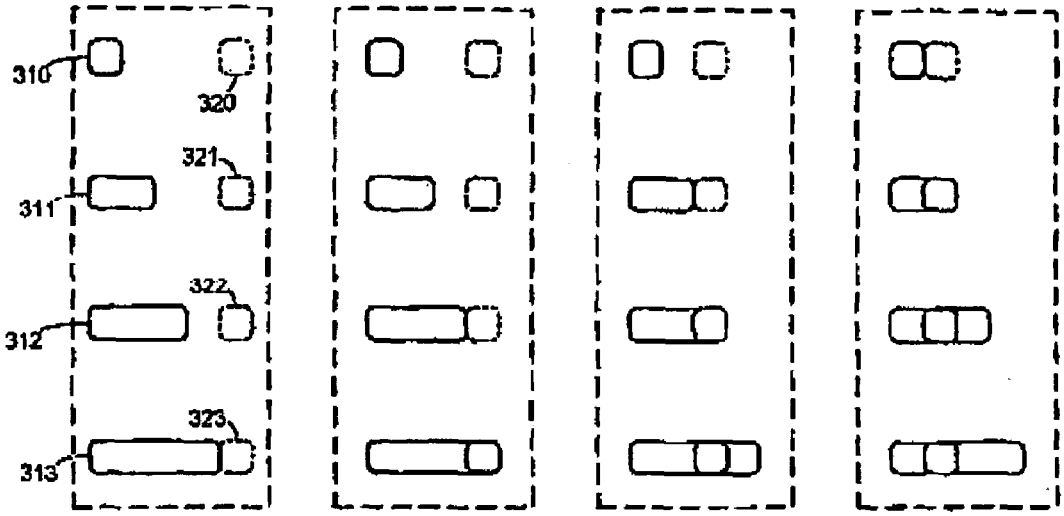
FIGS. 17A–17D are a set of diagrams illustrating a series of relative positions of apertures through tubular sleeves in one embodiment.
Figure 18A:
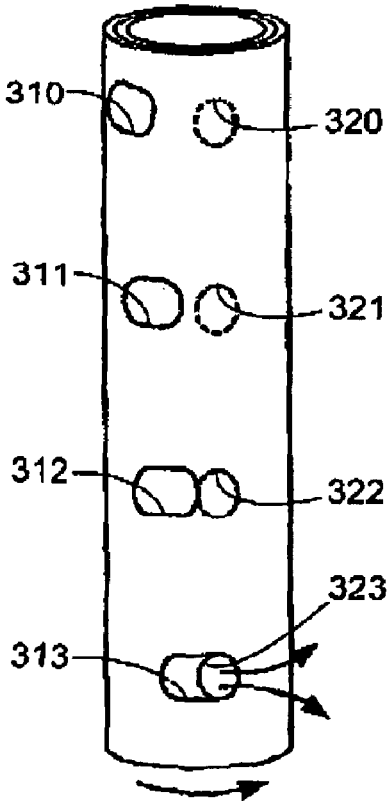
FIGS. 18A and 18B are perspective views of the sleeves corresponding to the linear views of FIGS. 17B and 17C.
Figure 18B:
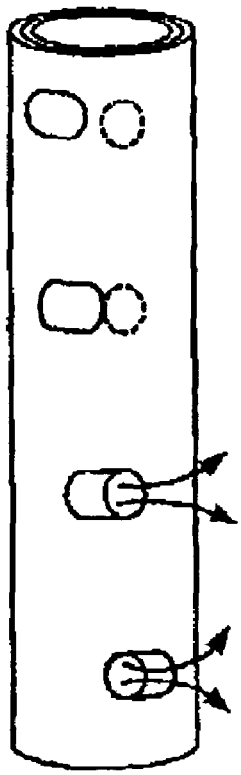

Referring to FIG. 17, a series of relative positions of the apertures through the tubular sleeves is shown for a particular set of aperture configurations. The positioning of the apertures is depicted in a linear fashion, even though the apertures are positioned around the circumferences of the respective tubular sleeves. The dashed line around each portion of the FIG. (17*a*–17*d*) is simply provided as a separator, and is not intended to depict a physical structure. FIGS. 18A and 18B are perspective views of the sleeves corresponding to the linear views of FIGS. 17B and 17C and use corresponding reference numbers.

In this configuration, the apertures through one of the tubular sleeves are indicated by reference numbers 310–313. The apertures through the other of the tubular sleeves is indicated by reference numbers 320–323. In the positions shown in FIG. 17*a*, none of the apertures of the two tubular sleeves overlap. Thus, no path is formed between interior flowpath 280 and exterior flowpath 290. FIG. 17*b* shows the positions of the apertures when the tubular sleeves are rotated with respect to each other. In this figure, aperture 313 overlaps with aperture 323, forming a path between the interior and exterior flowpaths. A gravel slurry flowing into interior flowpath 280 can therefore pass through apertures 313 and 323 and enter exterior flowpath 290. As the tubular sleeves are rotated further, overlap occurs between additional apertures. Referring to FIG. 17*c*, it can be seen that apertures 312 and 322 now overlap. Thus, there are two paths from the interior flowpath to the exterior flowpath. As the rotation of the tubular sleeves continues, additional paths are opened between the interior and exterior flowpaths.

The effect of the relative rotation of the tubular sleeves and the opening of successive apertures through the sleeves between the interior and exterior flowpaths is to initially force the gravel slurry flowing through the interior flowpath to flow into the exterior flowpath at the axial position of apertures 313 and 323. Then, the slurry is allowed to flow out at the axial position of apertures 312 and 322, then 311 and 321, and so on. It is contemplated that the apertures will initially provide openings at the far end of the well screen system (the end farthest from the wellhead) so that the flow of the gravel slurry is successively directed into segments of the production area beginning with the far and and working back to the near end of the well screen.

It is expected that this will provide benefits through two mechanisms. First, because the exterior flowpath is filled in successive segments, the gravel slurry may not traverse enough of the exterior flowpath to cause formation of gravel bridges. Second, because the exterior flowpath is filled from the bottom, formation of a gravel bridge will cause voids on the top or near side of the bridge. Because additional openings through the tubular sleeves are formed successively from bottom to top, a void which is formed on top of a bridge will be filled by a later-opening aperture through the tubular sleeves.

It is noted that mechanisms for rotating the tubular sleeves can be taken from those which are well-known in the field of downhole tools. Therefore, these mechanisms will not be discussed in detail here.

Figures 19A, 19B, 19C, 19D:
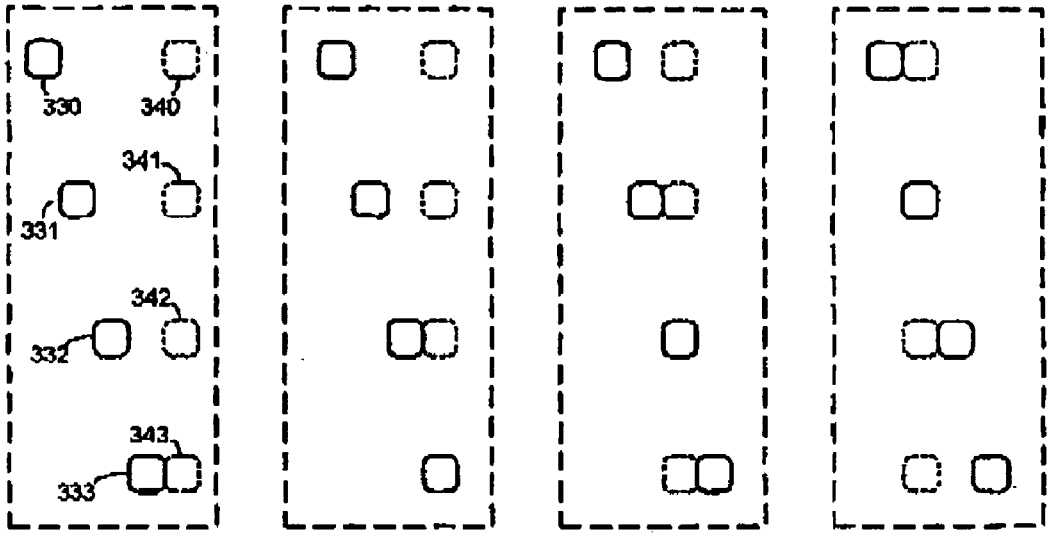
FIGS. 19A–19D are a set of diagrams illustrating a series of relative positions of apertures through tubular sleeves in an alternative embodiment.
Figure 20:
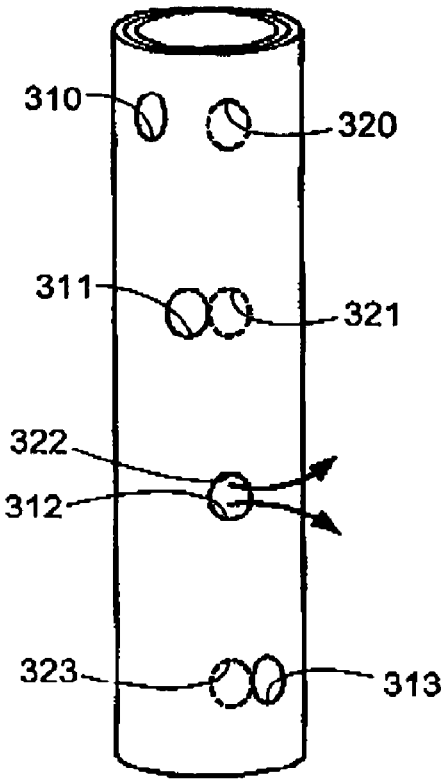
FIG. 20 is a perspective view of the sleeves corresponding to the linear view of FIG. 19C.

Referring to FIG. 19, an alternative configuration of the apertures is shown. FIG. 20 is a perspective view of the sleeves corresponding to the linear view of FIG. 19C and uses corresponding reference numbers. In this configuration, the apertures which are staggered (330–333) are all the same length, as compared to the variable-length apertures of FIG. 17 (310–313). Thus, when the tubular sleeves are rotated, only one or two pairs of apertures overlap at a time. As a result, the openings will "walk" their way up the length of the well screen, opening and then closing. In comparison, the configuration of FIG. 17 will cause the apertures to remain open, even as additional apertures opened along the length of the well screen.

Figure 21A:
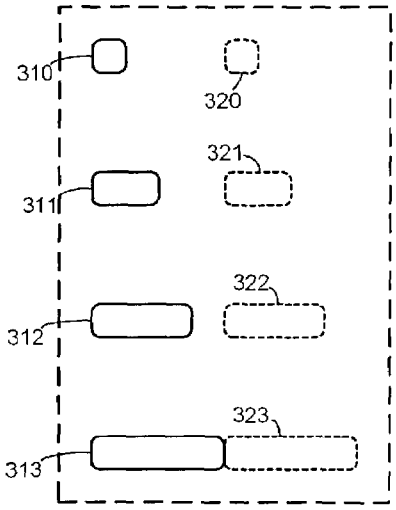
FIGS. 21A–21C are a set of diagrams illustrating a series of relative positions of apertures through tubular sleeves in another alternative embodiment.
Figure 21B:
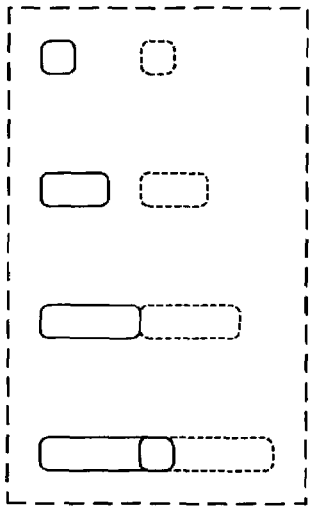
Figure 21C:
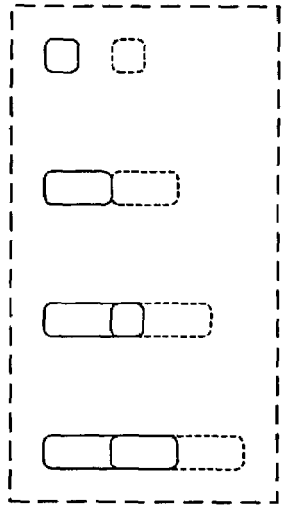

Still another alternative aperture configuration is shown in FIG. 21. In this configuration, both sets of apertures have variable lengths. As a result, the aperture at the bottom of the well screen (formed by apertures 353 and 363) will continue to expand as the tubular sleeves are rotated.

It should be noted that the aperture configurations depicted in FIGS. 17, 19 and 21 may cover only a portion of the respective circumference is of the tubular sleeves. Thus, the pattern of apertures may be repeated several times around the circumference of the sleeves. Still further, it should be noted that it is not necessary to configure the apertures so that they open successively along the entire length of the well screen. The well screen may be divided into several segments, each of which has a set of apertures configured as shown in one of these figures. Still further, it should be noted that additional variations of the aperture configurations will be obvious to persons of skill in the art of the invention. For example, the apertures may be configured to align as the sleeves are moved axially with respect to each other (rather than rotationally).

The benefits and advantages which may be provided by the present invention have been described above with regard to specific embodiments. These benefits and advantages, and any elements or limitations that may cause them to occur or to become more pronounced are not to be construed as critical, required, or essential features of any or all of the claims. As used herein, the terms 'comprises,' 'comprising,' or any other variations thereof, are intended to be interpreted as non-exclusively including the elements or limitations which follow those terms. Accordingly, a process, method, article, or apparatus that comprises a list of elements does not include only those elements but may include other elements not expressly listed or inherent to the claimed process, method, article, or apparatus.

While the present invention has been described with reference to particular embodiments, it should be understood that the embodiments are illustrative and that the scope of the invention is not limited to these embodiments. Many variations, modifications, additions and improvements to the embodiments described above are possible. It is contemplated that these variations, modifications, additions and improvements fall within the scope of the invention as detailed within the following claims.

The invention claimed is:

1. A system comprising:

a well screen having a first length in an axial direction; and a plurality of conduits positioned around the well screen;

wherein each conduit has a corresponding length in the axial direction between an inlet and an outlet, wherein the length of the conduit is shorter than the first length;

wherein the conduits are located at multiple, different axial positions along the length of the well screen with the length of each conduit overlapping axially with at least one other conduit;

wherein the plurality of conduits comprise a corrugated sheet wrapped around the well screen;

wherein the corrugated sheet is wrapped helically around the well screen; and wherein corrugations in the corrugated sheet are angled with respect to a lengthwise direction of the corrugated sheet such that when the corrugated sheet is wrapped helically around the well screen, the corrugations and corresponding conduits are aligned with the axial direction.

2. A method comprising:

positioning a well screen in a well bore;

positioning a plurality of conduits at multiple, different axial positions along the length of the well screen between the well screen and the well bore, wherein each conduit has an axial length between an inlet of the conduit and an outlet of the conduit, wherein the length of the conduit is shorter than a length of the well screen, and wherein each conduit overlaps axially with at least one other conduit; and pumping a gravel slurry between the well screen and the well bore and thereby filling a space between the well screen and the well bore with gravel;

wherein positioning the plurality of conduits between the well screen and the well bore comprises positioning a corrugated sheet around the well screen;

wherein positioning the corrugated sheet around the well screen comprises wrapping the corrugated sheet helically around the well screen such that separate conduits are formed by contact between portions of the corrugated sheet and corresponding portions of the well screen;

wherein the corrugated sheet has corrugations that are angled with respect to a lengthwise direction of the corrugated sheet and wherein wrapping the corrugated sheet helically around the well screen comprises wrapping the corrugated sheet around the well screen with a helical pitch at which the corrugations and corresponding conduits are aligned with an axis of the well screen.

* * * * *